US006184611B1

(12) United States Patent
Saito et al.

(10) Patent No.: US 6,184,611 B1
(45) Date of Patent: Feb. 6, 2001

(54) ELECTRON-EMITTING ELEMENT

(75) Inventors: Hirohisa Saito; Takashi Tsuno; Hiromu Shiomi; Yoshiaki Kumazawa; Takahiro Imai, all of Hyogo (JP)

(73) Assignee: Sumitomo Electric Industries, Ltd., Osaka (JP)

( * ) Notice: Under 35 U.S.C. 154(b), the term of this patent shall be extended for 0 days.

(21) Appl. No.: 09/037,514

(22) Filed: Mar. 10, 1998

(30) Foreign Application Priority Data

Mar. 10, 1997 (JP) ..... 9-055329

(51) Int. Cl.[7] ..... H01J 1/02

(52) U.S. Cl. ..... 313/310; 313/309; 313/336; 313/351; 445/50; 445/51

(58) Field of Search ..... 313/309, 310, 313/311, 336, 351, 495; 445/50, 51

(56) References Cited

U.S. PATENT DOCUMENTS

| | | | | |
|---|---|---|---|---|
| 5,180,951 | | 1/1993 | Dworsky et al. . | |
| 5,199,918 | | 4/1993 | Kumar . | |
| 5,341,063 | * | 8/1994 | Kumar | 313/309 |
| 5,552,613 | | 9/1996 | Nishibayashi et al. . | |
| 5,916,005 | * | 6/1999 | Baik et al. | 445/51 |

FOREIGN PATENT DOCUMENTS 08264862 3/1995 (JP) .

7-94077 4/1995 (JP) .

OTHER PUBLICATIONS

Geis et al, Diamond Field Emission Cathodes, Vacuum Microelectronics Conference, 1995, p. 277.*

Geis et al, Diamond Field Emission Cathodes, Vacuum Microelectronics Conference, 1993.*

K. Okano et al. "*Mold Growth of Polycrystalline Pyramidal–Shape Diamond for Field Emitters*" pp. 20–24 Received May 23, 1995; accepted in final form Jul. 14, 1995.

Diamond Grain with "Tip–structure" pp. 24 & 25 (1995).

"A novel low–field electron–emission polycrystalline diamond microtip array for sensor applications", Kang et al., Sensors and Actuators A, vol. A54, No. 1/03, Jun. 1996, pp. 724–727, XP000637200.

* cited by examiner

*Primary Examiner*—Michael H. Day
*Assistant Examiner*—Michael J. Smith
(74) *Attorney, Agent, or Firm*—McDermott, Will & Emery

(57) ABSTRACT

An electron-emitting element comprises a diamond substrate, and a diamond protrusion grown on a surface of the diamond substrate so as to have a pointed portion in a form capable of emitting an electron. Since the diamond protrusion formed by growth has a sharply pointed tip portion, it can fully emit electrons. Preferably, the surface of the diamond substrate is a {100} face, and the diamond protrusion is surrounded by {111} faces.

10 Claims, 16 Drawing Sheets

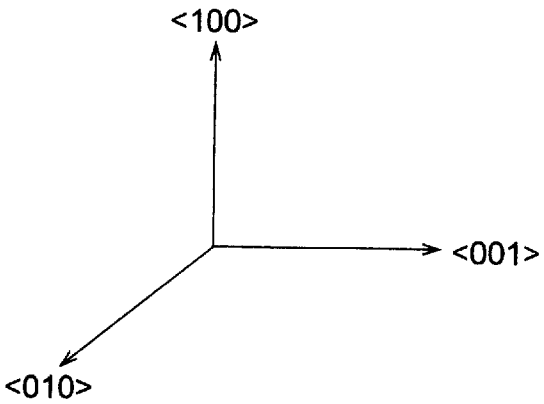
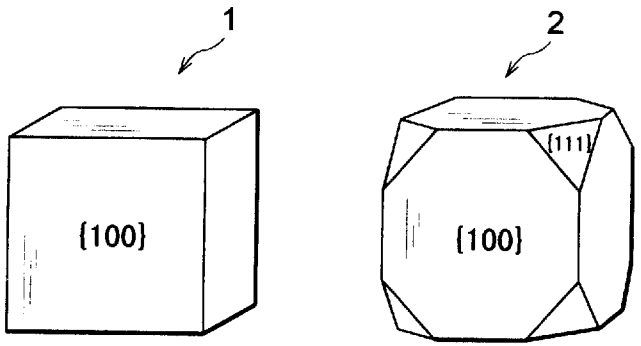
Fig.1A
Fig.1B
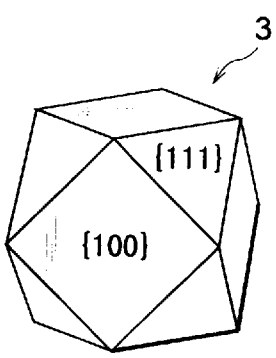
Fig.1C
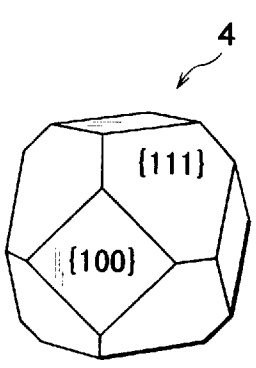
Fig.1D
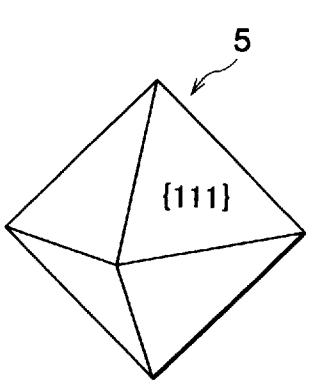
Fig.1E

ELECTRON-EMITTING ELEMENT

BACKGROUND OF THE INVENTION

1. Field of the Invention

The present invention relates to an electron-emitting element, a method of making the same, and an electronic device such as field-emission display (FED), field-emission microscope (FEM), or the like which uses an electron-emitting element.

2. Related Background Art

With the recent advance in minute processing in semiconductor technology, the field of vacuum microelectronics has been rapidly developing. Consequently, as an electronic device for the next generation having a function of displaying or the like, the field-emission display (FED) has come into expectation. It is due to the fact that, unlike the conventional CRT displays, the FED has two-dimensionally arranged minute electrodes which function as field-emission type electron-emitting elements, so that it is unnecessary to deflect and converge the electrons in principle, whereby the display can be easily made thinner or flatter.

As a material used for such a minute electrode, diamond has recently been noticed. It is due to the fact that diamond has a very advantageous characteristic as an electron-emitting device, i.e., its electron affinity is negative. Accordingly, when diamond is pointed and employed as a minute electrode, it can emit electrons at a low voltage.

As a method of making pointed diamond, the following methods have been reported. For example, Japanese Patent Application Laid-Open No. 7-94077 discloses that, when a partially masked diamond substrate is etched, pointed diamond projecting from the substrate surface can be obtained. Also, *NEW DIAMOND,* 39, vol. 11, No. 4, pp. 24–25 (1995), reports that an isolated particle of diamond having a pointed form with no grain boundary is obtained as being oriented to (111) surface on a Cu substrate.

SUMMARY OF THE INVENTION

The conventional electron-emitting elements, however, have not been capable of sufficiently emitting electrons. In view of such a problem, it is an object of the present invention to provide an electron-emitting element which can sufficiently emit electrons, a method of making the same, and an electronic device.

In order to overcome the above-mentioned problem, the inventors have first taken account of single-crystal diamond with no grain boundary. There are many crystal morphologies in single-crystal diamond. FIGS. 1A to 1E are perspective views respectively showing typical morphologies of single-crystal diamond. As clearly shown in FIGS. 1A to 1E, each of single-crystal diamonds 1 to 5 is pointed at a part surrounded by crystal faces. This part contains only one carbon atom. Here, the pointing reaches its limit at a microscopic atomic level as observed by an electron microscope or the like. In the diamonds 1, 3, and 5 in particular, the radius of curvature of the pointed part is very small.

Meanwhile, diamond belongs to the cubic system; and the pointed parts shown in FIGS. 1A, 1C, and 1E are respectively positioned in the directions of crystal orientations <111>, <110>, and <100>. Also, these directions are respectively perpendicular to faces with face indices of {111}, {110}, and {100}. Here, the crystal orientation refers to a direction inherent in a crystal indicated by a face index with reference to a crystallographic axis which is a coordinate axis of three ridges intersecting at a common point of a unit lattice; whereas the face index refers to a reciprocal of the value obtained when the distance from the common point to a point where the face intersects with the crystallographic axis is divided by a unit length of the crystallographic axis.

Accordingly, when such single-crystal diamond 1, 3, or 5 is integrally formed by homo-epitaxial growth or the like at a desired position on a matrix having such a face index, it is pointed perpendicularly above the matrix at an atomic level, thereby overcoming the above-mentioned problem. Therefore, by taking this point into account, the inventors have attained the following invention.

Namely, the electron-emitting element in accordance with the present invention comprises a diamond substrate, and a diamond protrusion grown on a surface of the diamond substrate so as to have a pointed portion in a form capable of emitting an electron. The diamond protrusion formed by growth has a sharply pointed tip portion, thereby being capable of sufficiently emitting electrons.

Preferably, the surface of the diamond substrate is a {100} face, and the diamond protrusion is surrounded by {111} faces. Alternatively, while the surface of the diamond substrate is a {110} face, the diamond protrusion may be surrounded by {111} and {100} faces. Also, the surface of the diamond substrate may be a {111} face, with the diamond protrusion being surrounded by {100} faces.

Each diamond protrusion of such a diamond member, i.e., protruded portion, is surrounded by its inherent crystal faces governed by the symmetric property of the crystal structure of diamond, thereby exhibiting so-called automorphism. In this case, electric and mechanic characteristics and the like of the protruded portion are those inherent in the single-crystal diamond. Also, the protruded portion is pointed at an atomic level and has a shape determined by the face index of the substrate surface. Further, the surface of the protruded portion is very stable in terms of energy. Thus, a diamond member with a uniform quality can be easily obtained.

On the other hand, as mentioned above, diamond is a material having a negative electron affinity and is excellent in terms of electron-emitting characteristic. Accordingly, when its protrusion tip is not completely pointed, i.e., a minute area of plane or ridge line is left at the tip, it can be expected to become effective in increasing the current of emitted electrons. Namely, as the form of the diamond protrusion that can sufficiently emit electrons, the following can be noted.

First, the diamond protrusion preferably has a quadrangular pyramid portion exposing its tip part. In particular, when a {100} diamond substrate is used, a truncated quadrangular pyramid portion is spread on the skirt side of the quadrangular pyramid portion. Specifically, this diamond protrusion has a truncated quadrangular pyramid portion whose upper and bottom surfaces are respectively continuous with the bottom surface of the quadrangular pyramid portion and the surface of the diamond substrate, while the angle formed between a side ridge line of the truncated quadrangular pyramid portion and the surface of the diamond substrate is smaller than the angle formed between a side ridge line of the quadrangular pyramid portion and the surface of the diamond substrate.

The diamond protrusion may have a truncated quadrangular pyramid portion exposing the upper surface thereof.

The diamond protrusion may have a form surrounded by a first ridge line in parallel to the substrate surface, second and third ridge lines extending so as to spread from one end of the first ridge line toward the surface, and fourth and fifth ridge lines extending so as to spread from the other end of the first ridge line toward the surface.

In order for the diamond substrate to match the diamond protrusion in terms of lattice, the diamond substrate is preferably single-crystal diamond. It is due to the fact that crystal defects consequently become hard to be introduced into the protrusion, whereby quality is kept from deteriorating. As the diamond substrate, polycrystal diamond can also be used.

The method of making an electron-emitting element in accordance with the present invention comprises: (a) a step of preparing a diamond substrate; (b) a step of forming a seed projection on a surface of the diamond substrate by diamond; and (c) a step of forming a diamond protrusion by epitaxially growing diamond at the seed projection by vapor-phase synthesis using the seed projection as a nucleus.

As the nucleus of crystal growth is thus intentionally disposed as the seed projection on the substrate, the position at which the protruded portion is to be integrally formed on the surface of the substrate can be definitely determined, whereby the electron-emitting element made of a diamond member can be made easily.

In order for diamond of the protruded portion to epitaxially grow on a surface in a favorable manner, the surface is preferably selected from the group consisting of {100}, {110}, and {111} faces.

In order to match diamond of the seed projection with the substrate in terms of lattice so as to restrain crystal defects from being introduced, the substrate is preferably made of single-crystal diamond or polycrystal diamond. As a result, crystal defects are kept from propagating to the protruded portion formed at the seed projection, whereby the quality of the diamond member can be prevented from deteriorating.

When the surface is a {100} face, the growth rate ratio is preferably set to $\sqrt{3}$ or greater. When the surface is a {111} face, the growth rate ratio is preferably set to $1/\sqrt{3}$ or lower. When the surface is a {110} face, the growth rate ratio is preferably set to $(\sqrt{3})/2$.

In the case where the ratio of the growth rate of diamond epitaxially grown at the seed projection in the <111> direction to that in the <100> direction is thus changed, the protruded portion can be favorably pointed. The above-mentioned values are based on the fact that the crystal structure of diamond belongs to the cubic system in which the ratio of the lattice spacing in {111} face to the lattice spacing in {100} face is $\sqrt{3}$.

Preferably, the above-mentioned step (b) comprises: a step of forming a mask on a part of the surface of the diamond substrate where the seed projection is to be formed; a step of etching a part of the surface of the diamond substrate where the mask is not formed; and a step of removing the mask after the etching. As a result, the seed projection can be formed at a desired position of the substrate surface.

Alternatively, the above-mentioned step (b) may comprise: a step of forming a mask so as to expose only a part of the surface of the substrate where the seed projection is to be formed, a step of epitaxially growing diamond by vapor-phase synthesis at the part of the surface of the diamond substrate where the seed projection is to be formed, and a step of removing the mask after the epitaxial growth.

When the height of the seed projection is too much, abnormal growth may occur from its side face. When the diameter of the seed projection is too much, it may take a very long time for pointing the protruded portion. Consequently, in the case where the surface is a {110} face, for example, the automorphism of {110} face may not appear at the protruded portion, thereby disadvantageously roughening the substrate surface. Thus, it is preferred that the seed projection be formed like substantially a circular cylinder having a height of 1 to 100 $\mu$m and a diameter of 0.5 to 10 $\mu$m. When the seed projection has such a size, without generating abnormal growth, the time required for pointing the protruded portion can be reduced, whereby the protruded portion can be favorably pointed. In particular, when the seed projection is formed like substantially a circular cylinder having a height of 2 to 10 $\mu$m and a diameter of 0.5 to 10 $\mu$m, the protruded portion can be pointed more prominently, so as to be efficiently applicable to the electronic device explained later.

In other words, it is preferred that the mask have an opening within which the seed projection is to be formed, with the diameter of the opening being set such that the diameter of the seed projection becomes 0.5 to 10 $\mu$m. The above-mentioned etching or epitaxial growth is preferably performed till the height of the seed projection becomes 1 to 100 $\mu$m or more preferably 2 to 10 $\mu$m.

The electronic device in accordance with the present invention comprises a vacuum envelope within which the electron-emitting element is disposed, and an electron-drawing electrode disposed within the vacuum envelope, in which a voltage is applicable between the electron-drawing electrode and the electron-emitting element.

As mentioned above, automorphism appears at the diamond protrusion of the electron-emitting element made of a diamond member, whereby the diamond protrusion is pointed at an atomic level. Such a protruded portion has a form which is quite advantageous to field emission. Also, the protruded portion is integrally formed with the substrate, thus yielding no interface therebetween which may cause contact resistance or the like. Accordingly, the voltage applied to a control electrode in order to draw electrons from the protruded portion can be reduced.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 1A, 1B, 1C, 1D, and 1E are perspective views of crystal morphologies of diamond;

DETAILED DESCRIPTION OF THE PREFERRED EMBODIMENTS

In the following, preferred embodiments of the present invention will be explained in detail with reference to the accompanying drawings. Among the drawings, parts identical or equivalent to each other will be referred to with numerals or letters identical to each other.

Figure 2:
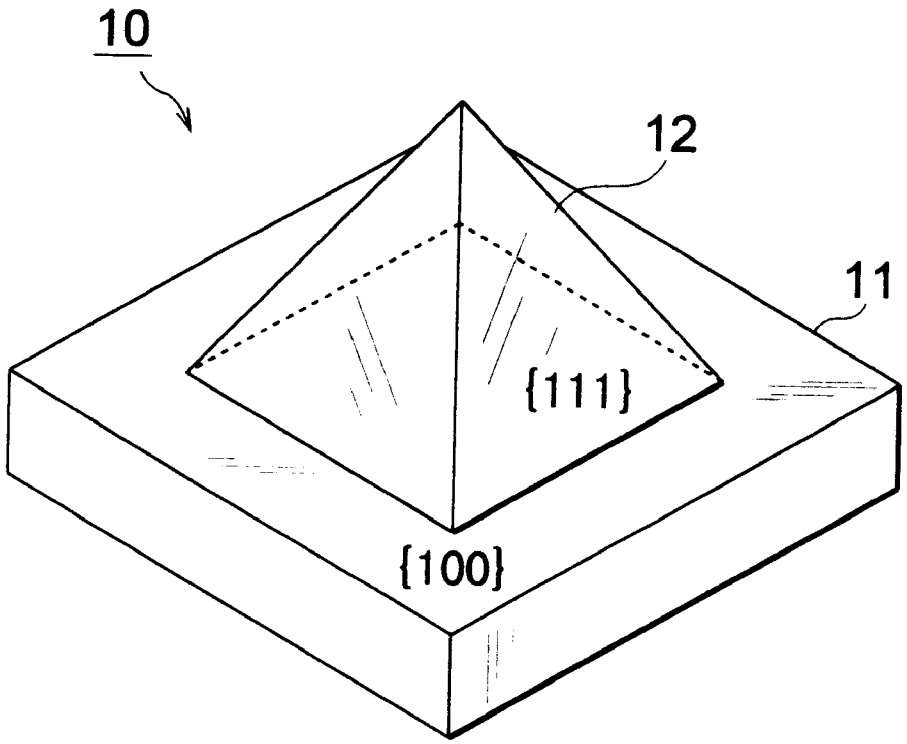
FIG. 2 is a perspective view showing an embodiment of a diamond member.

FIG. 2 is a perspective view of a part (basic unit portion) of a diamond member 10. The depicted diamond member 10 comprises a matrix or substrate 11 whose surface is a {100} face of Ib type single-crystal diamond having a high crystallizability, and a protruded portion integrally formed on the surface of the substrate 11 by diamond having no grain boundary, i.e., diamond protrusion 12.

Diamond belongs to the cubic system. Consequently, the protruded portion 12 integrally formed with the substrate 11 whose surface is a {100} face of diamond has a crystal morphology surrounded by {111} faces of diamond. In this case, the protruded portion 12 is pointed in the direction of crystal orientation <100>. This <100> direction is perpendicular to the diamond {100} face. Accordingly, the protruded portion 12 is perpendicularly pointed with respect to the surface of the substrate 11 and is integrally formed therewith.

The leading edge part of the protruded portion 12 ideally has only one carbon atom. Consequently, the pointing has reached its limit at a microscopic atomic level as being observed by an electron microscope or the like, and the radius of curvature is small.

Also, the protruded portion is surrounded by its inherent crystal faces governed by the symmetric property of the crystal structure of diamond, thereby exhibiting so-called automorphism. In this case, electric and mechanic characteristics and the like of the protruded portion 12 are those inherent in the single-crystal diamond. Also, the surface of the protruded portion 12 is very stable in terms of energy. Thus, the diamond member 10 with a uniform quality can be easily obtained.

In particular, in this embodiment, since the substrate is made of Ib type single-crystal diamond, this substrate and the protruded portion match each other in terms of lattice at their interface, whereby crystal defects are hard to be introduced into the protruded portion. As a result, the diamond member exhibits an excellent quality.

Nonetheless, the matrix should not be restricted to that made of Ib type single-crystal diamond. Effects similar to those of Ib type single-crystal diamond are also obtained when the matrix is made of a natural type diamond single crystal, since it has a high crystallizability. Also, when a single-crystal diamond film hetero-epitaxially grown on a substrate of Cu, c-BN, or the like, or a polycrystal diamond film whose crystal face has a high orientation characteristic is used as the matrix in view of economy, notwithstanding poor crystallizability, a useful protruded portion can be formed.

In the following, the method of making a diamond member in accordance with the present invention will be explained. FIGS. 3A to 3E are perspective views showing respective parts of a process of making a diamond member 20 in which basic unit portions each shown in FIG. 2 are arranged two-dimensionally.

Figure 3A:
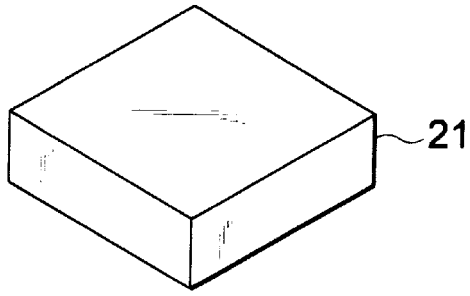
FIGS. 3A, 3B, 3C, 3D, and 3E are perspective views showing respective parts of a process of making the diamond member.
Figure 3B:
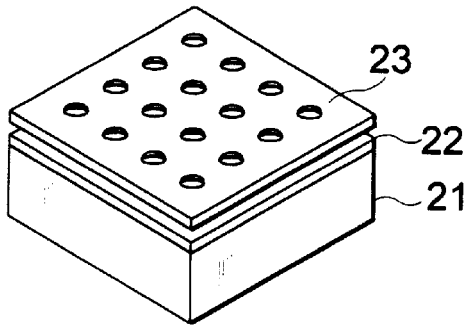
Figure 3C:
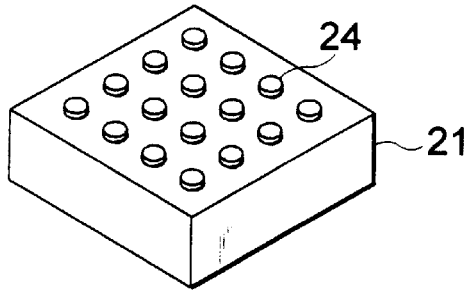
Figure 3D:
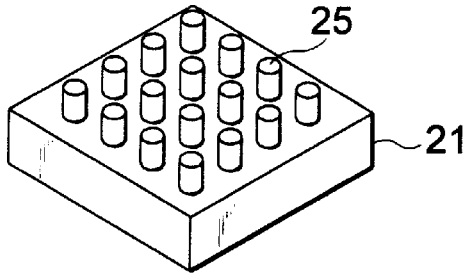

Initially prepared is a substrate 21 made of Ib type single-crystal diamond whose surface is a {100} face (FIG. 3A). Then, a resist layer 22 is formed on the substrate 21, and a photomask 23 for forming a desired pattern, i.e., a two-dimensional dot pattern having a pitch width of 1 to 500 $\mu$m, is disposed thereon. Thereafter, photolithography technique is used for forming the above-mentioned pattern on the resist layer 22 (FIG. 3B). Then, etching technique is used for forming mask layers 24 corresponding to the pattern of the resist layer 22 (FIG. 3C).

Subsequently, reactive ion etching (RIE) technique is used for dry-etching the substrate 21 (FIG. 3D), thereby integrally forming cylindrical bulged portions (seed projection) 25. In order for protruded portions 26 of the diamond member 20 to be formed as being pointed, it is preferred that each bulged portion be formed into substantially a circular cylinder having a height of 1 to 100 $\mu$m and a diameter of 0.5 to 10 $\mu$m.

Namely, the diameter of each opening formed in the mask is slightly larger than 0.5 to 10 $\mu$m, and etching is effected till the height of each bulged portion 25 becomes 1 to 100 $\mu$m. When the height of the bulged portion 25 is too much, abnormal growth may occur from its side face; whereas, when the diameter of the bulged portion 25 is too much, it may take a very long time for pointing the protruded portion 26. Consequently, in the case where the surface is a {110} face, for example, the automorphism of {110} face may not appear at the protruded portion 26, thereby disadvantageously roughening the substrate. When the bulged portion has the above-mentioned size, by contrast, without generating abnormal growth, the time required for pointing the protruded portion 26 can be reduced, whereby the protruded portion 26 can be favorably pointed. In particular, when the bulged portion 25 is formed like substantially a circular cylinder having a height of 2 to 10 $\mu$m and a diameter of 0.5 to 10 $\mu$m, the protruded portion 26 can be pointed more prominently, so as to be efficiently applicable to the electronic device explained later. That is, the diameter of each opening formed in the mask is slightly larger than 0.5 to 10 $\mu$m, and etching is performed till the height of each bulged portion 25 becomes 2 to 10 $\mu$m.

Here, the RIE technique is used because not only the protruded portion can be easily formed thereby but also the part other than the protruded portion can be smoothly etched thereby. It is due to the fact that this technique is advantageous in that it can easily dig the mask layer 24 perpendicularly. As a result, the difference between the bulged portion of the matrix and the other portion can appear clearly. Here, the reactive gas used in the RIE technique is preferably a gas consisting of $O_2$ alone or a mixed gas comprising at least $CF_4$ and $O_2$. While the volume ratio in the mixed gas is determined in view of the etching rate and the smoothness of the matrix surface, a desired matrix surface can be relatively easily obtained when the ratio of volume fraction of $CF_4$ to the volume fraction of $O_2$ is greater than 0 but not greater than 0.5.

Figure 3E:
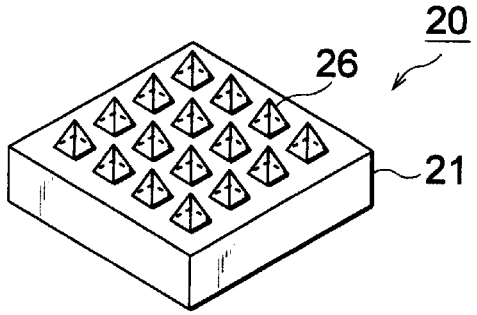

Then, by using each bulged portion 25 on the substrate 21 as a nucleus for vapor-phase growth of diamond, microwave CVD technique is used for epitaxially growing diamond (FIG. 3E).

Figure 4:
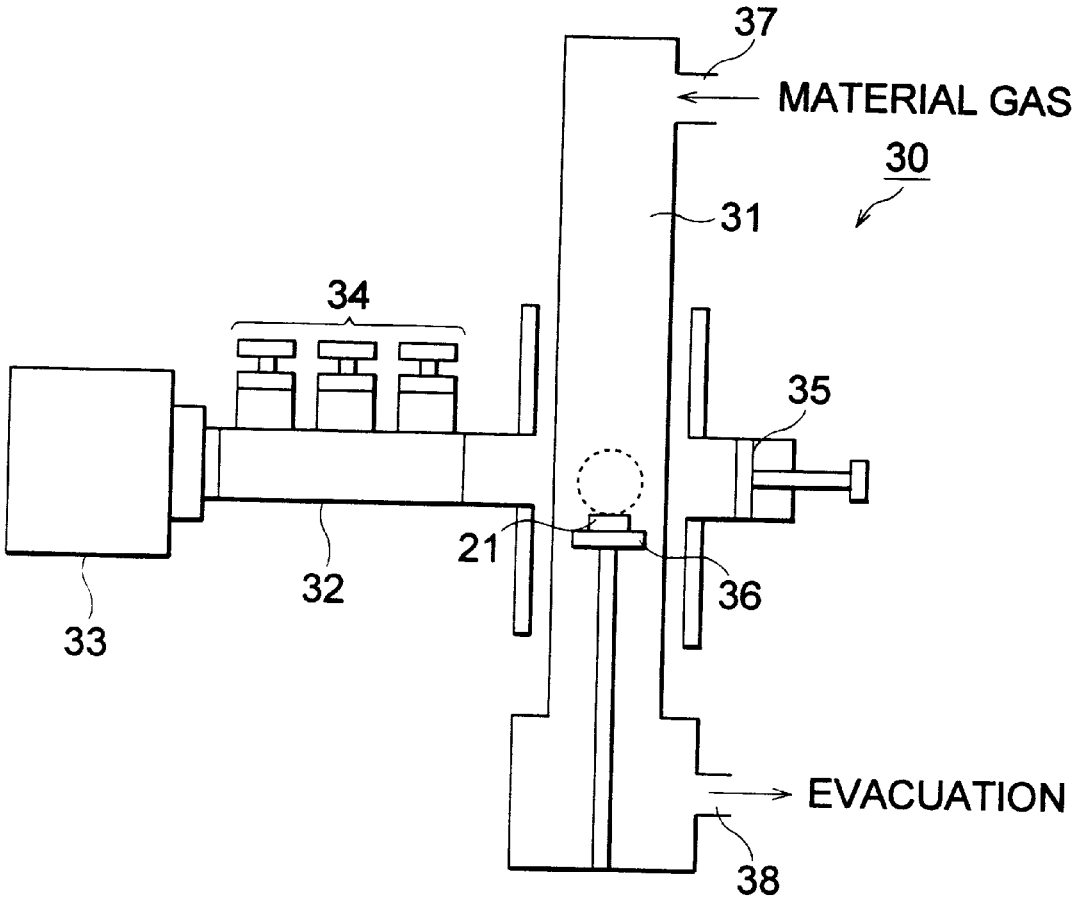
FIG. 4 is a sectional view of a microwave CVD apparatus.

FIG. 4 is a view schematically showing a microwave CVD apparatus 30 for performing this microwave CVD technique. The microwave CVD apparatus 30 has a reaction chamber 31 which is made of a silica tube in order to pass microwaves therethrough. A waveguide tube 32 is disposed so as to intersect with the reaction chamber 31. Disposed on one end side of the waveguide tube 32 is a microwave generating section comprising a microwave power supply 33, which generates microwaves according to oscillation of a magnetron, and a non-depicted isolator for passing microwaves therethrough only along one direction. A three-pillar matching device 34 is disposed between the microwave generating section and the reaction chamber 31, whereas a short-circuiting plunger matching device 35 is disposed on the other end side of the waveguide tube 32, whereby impedance is adjusted so as to minimize reflection electric power of microwaves. A substrate holder 36 is disposed at a position where the reaction chamber 31 and the waveguide tube 32 intersect with each other, whereas the substrate 21 is mounted on the substrate holder 36. The upper part of the reaction chamber 31 is provided with a supply port 37 for supplying the reaction gas, whereas the lower part of the reaction chamber 31 is provided with an exhaust port 38 for evacuating the reaction chamber 31 by means of a rotary pump or the like.

In order to use such microwave CVD apparatus 30 to epitaxially grow diamond on the substrate 21 on which the bulged portion 25 for the nucleus of growth is formed, the substrate 21 is initially mounted on the substrate holder 36. Then, the reaction chamber 31 is evacuated by the rotary pump to a predetermined pressure. Thereafter, a material gas is introduced from the supply port 37 at an appropriate flow rate, and the pressure within the reaction chamber 31 is held at a predetermined level. In order to improve the field-emission characteristic of the protruded portion 26, the material gas preferably includes a gas containing a group V element such as nitrogen (N) or phosphorus (P).

Subsequently, the microwave power supply 33 is turned on, so as to excite the material gas, thereby generating plasma as indicated by the dotted circle in FIG. 4. Here, the electric power applied to the microwave power supply 33 is appropriately adjusted so as to set the temperature of the substrate 21 to a predetermined level. The temperature of the substrate 21 is determined by a pyrometer (not depicted) from above the reaction chamber 31. When crystals are grown in such a state for a predetermined period of time, the ratio of the growth rate of diamond in <100> direction to that in <111> direction becomes √3 or greater, whereby the protruded portion 26 having a crystal morphology surrounded by {111} faces of diamond can be formed at the position of each bulged portion 25 as shown in FIG. 3E.

Since the nucleus of crystal growth is thus intentionally disposed as the bulged portion 25 on the substrate 21, the position at which the protruded portion 26 is to be integrally formed on the surface of the substrate 21 can be definitely determined, whereby the diamond member 20 can be made easily.

When the growth rate ratio is smaller than √3, the protruded portion is less likely to be pointed. Also, the growth rate ratio value of √3 assumes the case where crystal growth advances from one carbon atom. Accordingly, in the case where crystal growth advances from a substrate surface made of a number of carbon atoms, depending on the surface state of the substrate, diamond may forever fail to be pointed, thereby allowing its crystal to grow while keeping the shape of the substrate surface. Therefore, the growth rate ratio is set to √3 or greater.

Though a preferred embodiment of the diamond member in accordance with the present invention is explained in the foregoing, the present invention should not be restricted thereto.

Figure 5A:
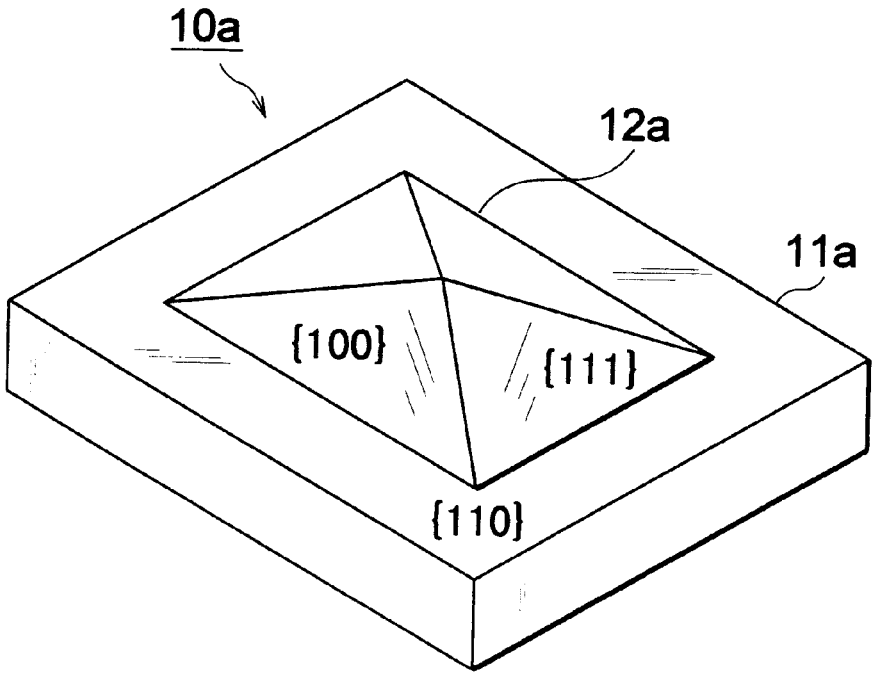
FIGS. 5A and 5B are perspective views respectively showing other embodiments of the diamond member.
Figure 5B:
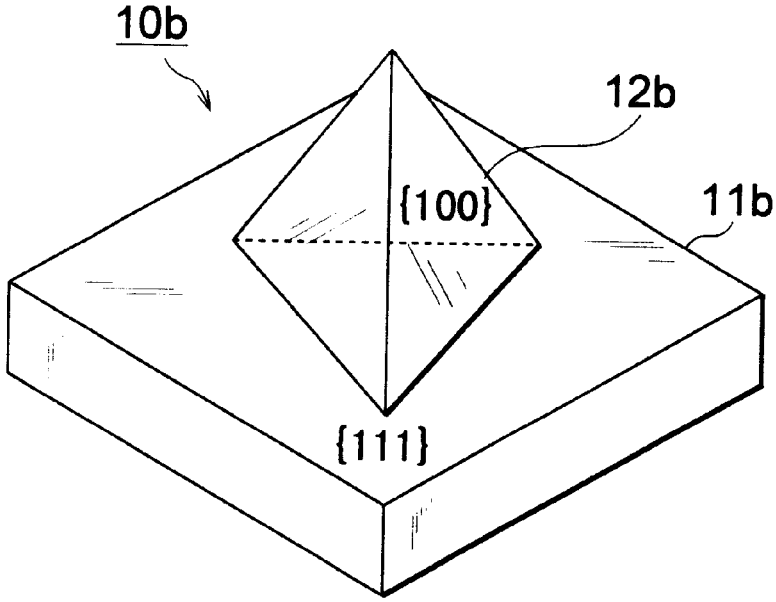

FIGS. 5A and 5B are perspective views respectively showing other embodiments of the diamond member in accordance with the present invention. Unlike the diamond member 10 of the above-mentioned embodiment, the diamond member 10*a* shown in FIG. 5A has a matrix or substrate 11*a* whose surface is a {110} face of diamond. Also, its protruded portion 12*a* exhibiting automorphism on the surface has a crystal morphology surrounded by {111} and {100} faces of diamond, unlike the protrusion 12 having a crystal morphology surrounded by {111} faces. In this case, the protruded portion 12*a* is pointed in the direction of crystal orientation <110>. The <110> direction is perpendicular to the {110} face of diamond. Accordingly, as with the protruded portion 12 of the above-mentioned embodiment, the protruded portion 12*a* is pointed perpendicularly to the surface of the substrate 11*a* and is integrally formed therewith.

The method of making the diamond member 10*a* shown in FIG. 5A is substantially the same as that of making the above-mentioned diamond member 20 but differs therefrom in that the surface of the substrate 11*a* to be prepared is a {110} face of diamond. Further, the composition of the material gas used for epitaxially growing diamond at the bulged portion, temperature of the substrate 11*a,* and the like are respectively different from the composition of the material gas, temperature of the substrate 21, and the like for performing the method of making the diamond member 20. It is due to the fact that, when the protruded portion 12*a* of the diamond member 10*a* is to be formed, the ratio of the growth rate of diamond in <100> direction to that in <111> direction is set to (√3)/2 so as to yield a desired diamond member.

Unlike the diamond members 10 and 10*a* respectively shown in FIGS. 2 and 5A, the diamond member 10*b* shown in FIG. 5B comprises a substrate 10*b* whose surface is a {111} face of diamond. Also, its protruded portion 12*b* exhibiting automorphism on the surface has a crystal morphology surrounded by {100} faces of diamond, unlike the protrusions 12 and 12*a* shown in FIGS. 2 and 5A having crystal morphologies surrounded by {111} faces and {111} and {100} faces, respectively. In this case, the protruded portion 12*b* is pointed in the direction of crystal orientation <111>. The <111> direction is perpendicular to the {111} face of diamond. Accordingly, as with the above-mentioned protruded portions 12 and 12*a,* the protruded portion 12*b* is pointed perpendicularly to the surface of the substrate 11*b* and is integrally formed therewith.

The method of making the diamond member 10*b* shown in FIG. 5B is substantially the same as those of making the above-mentioned diamond members 20 and 10*a* but differs therefrom in that the surface of the substrate 11*b* to be prepared is a {111} face of diamond. Further, the composition of the material gas used for epitaxially growing diamond at the bulged portion, temperature of the substrate 11*b*, and the like are respectively different from the composition of the material gas, temperature of the substrate 21 or 11*a*, and the like for performing the method of making the diamond member 20 or 10*a*. It is due to the fact that, when the protruded portion 12*b* of the diamond member 10*b* is to be formed, the ratio of the growth rate of diamond in <100> direction to that in <111> direction is set to 1/√3 or less so as to yield a desired diamond member.

Here, when the growth rate ratio is greater than 1/√3, the protruded portion is less likely to be pointed. Also, the growth rate ratio value of 1/√3 assumes the case where crystal growth advances from one carbon atom. Accordingly, in the case where crystal growth advances from a substrate surface made of a number of carbon atoms, depending on the surface state of the substrate, diamond may forever fail to be pointed, thereby allowing its crystal to grow while keeping the shape of the substrate surface. Therefore, the growth rate ratio is set to 1/√3 or less.

Figure 6:
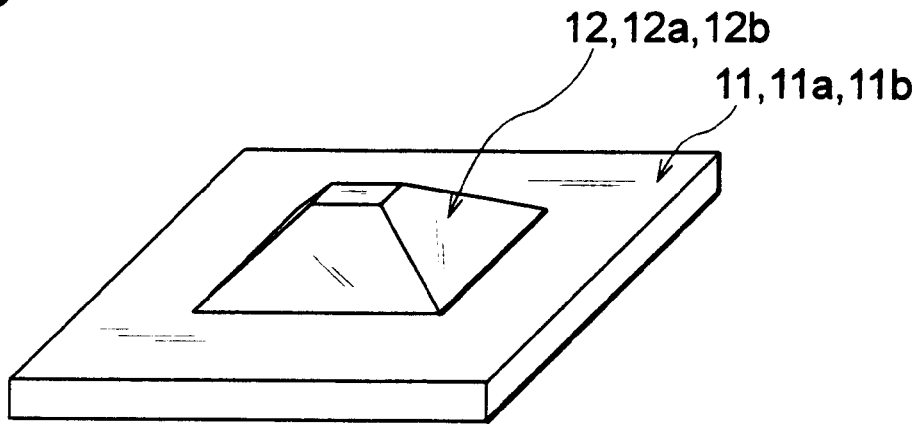
FIG. 6 is a perspective view showing another embodiment of the diamond member.

FIG. 6 is a perspective view of a diamond member obtained when making of the diamond member shown in FIGS. 2, 5A, or 5B is left unfinished. This diamond member has a quadrangular pyramid portion 12, 12*a*, or 12*b* with an exposed tip part disposed on the diamond substrate 11, 11*a*, or 11*b*. Such a diamond member can also function as a favorable electron-emitting element.

Figure 7:
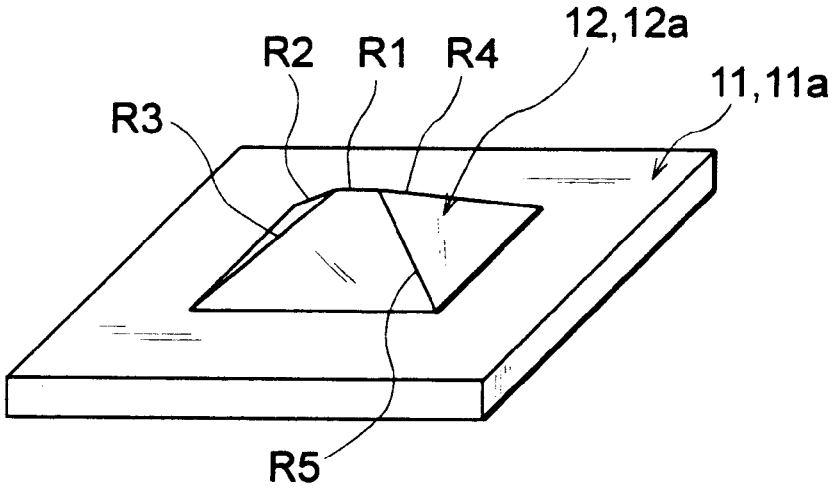
FIG. 7 is a perspective view showing another embodiment of the diamond member.

FIG. 7 is a perspective view of a diamond member obtained when, upon forming the bulged portion 25 in the making of the diamond member shown in FIG. 2 or 5A, the shape of the bulged portion 25 is slightly deformed from a circular cylinder, e.g., to an elliptic cylinder. The diamond protrusion 12 or 12*a* of this diamond member has a form surrounded by a first ridge line R1 in parallel to the surface of the substrate 11 or 11*a*, second and third ridge lines R2 and R3 extending so as to spread from one end of the first ridge line R1 toward the substrate surface, and fourth and fifth ridge lines R4 and R5 extending so as to spread from the other end of the first ridge line R1 toward the surface of the substrate. Such a diamond member can also function as a favorable electron-emitting element.

In the case where a diamond protrusion is grown on a (100) diamond substrate surface, its form is substantially a quadrangular pyramid portion as shown in FIG. 2 but not accurately a quadrangular pyramid portion in practice.

Figure 8:
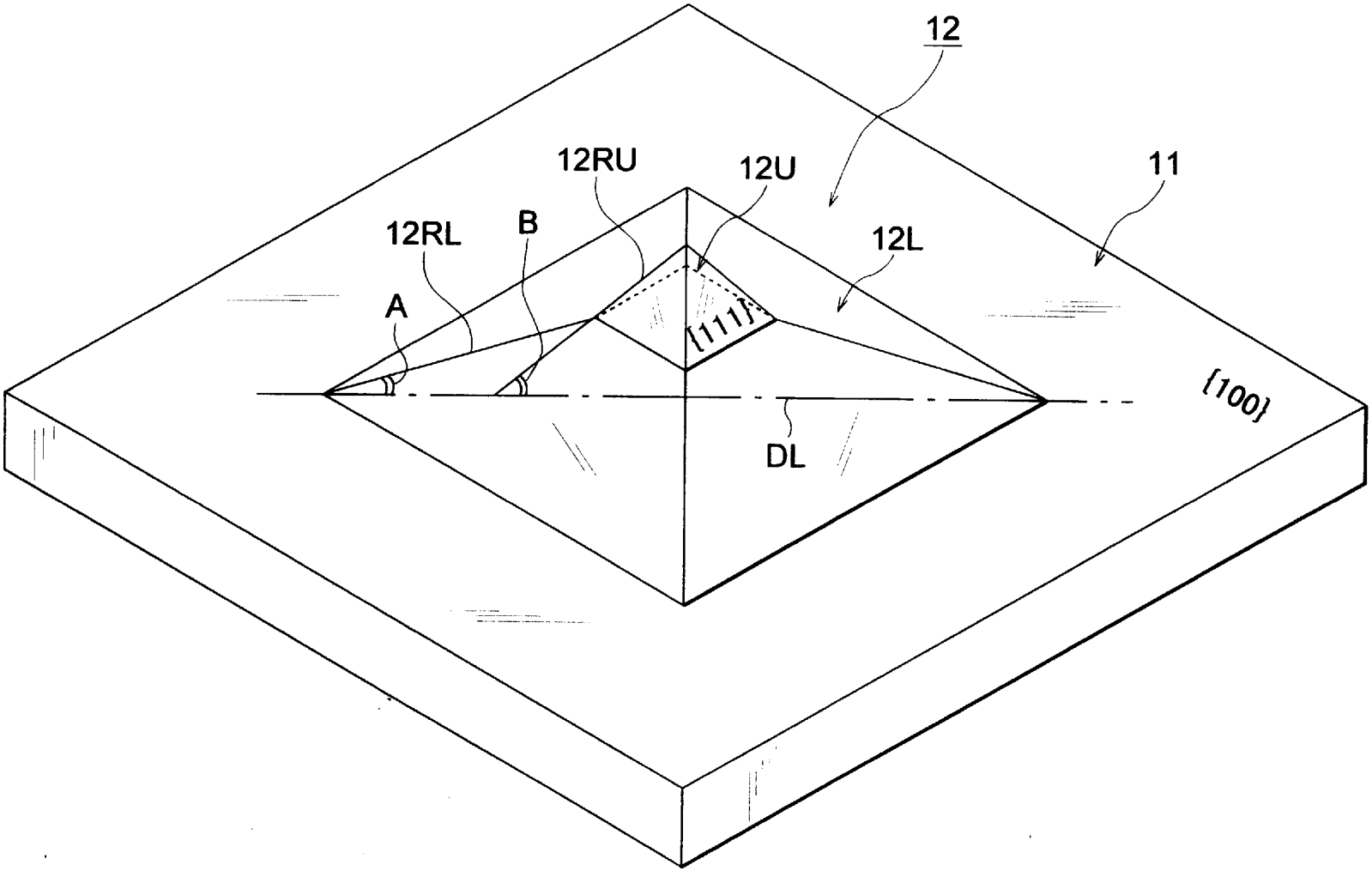
FIG. 8 is a perspective view showing the diamond member in detail.

FIG. 8 is a perspective view showing the form of an actual diamond protrusion 12. This diamond protrusion 12 comprises a quadrangular pyramid portion 12U with an exposed tip part and a truncated quadrangular pyramid portion 12L whose upper and bottom surfaces are respectively continuous with the bottom surface of the quadrangular pyramid portion 12U and the surface of a diamond substrate 11. The angle A formed between a side ridge line $12R_L$ of the truncated quadrangular pyramid portion 12L and the surface of the diamond substrate 11 is smaller than the angle B formed between a side ridge line $12R_U$ of the quadrangular pyramid portion 12U and the surface of the diamond substrate 11. Specifically, assuming that the angle formed between one diagonal DL of the quadrangle constituting the bottom surface of the truncated quadrangular pyramid portion 12L and the side ridge line $12R_L$ of the truncated quadrangular pyramid portion 12L intersecting with the diagonal DL is A, and that the angle formed between the diagonal DL and the side ridge line $12R_U$ of the quadrangular pyramid portion 12U whose one end is continuous with the side ridge line $12R_L$ is B, both angles A and B are acute angles, while the angle A is smaller than the angle B.

Figure 9A:
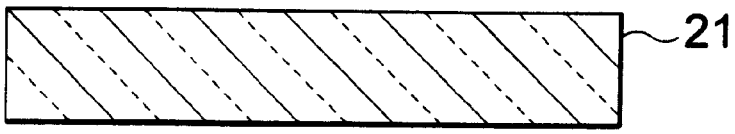
FIGS. 9A, 9B, 9C, and 9D are sectional views showing respective parts of another process of making the diamond member.
Figure 9B:
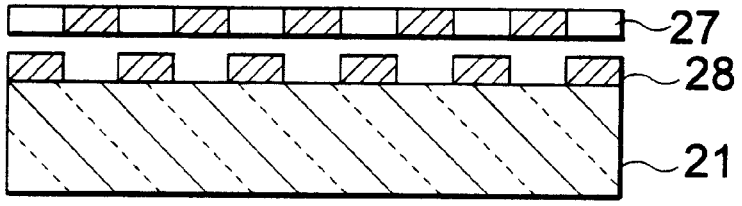
Figure 9C:
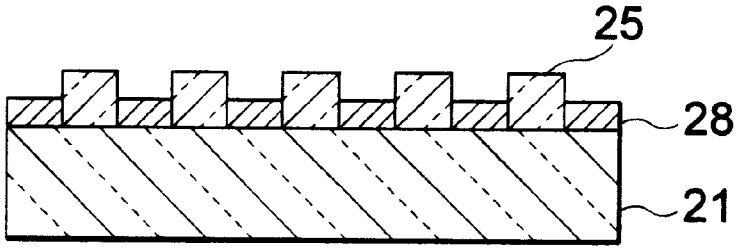
Figure 9D:
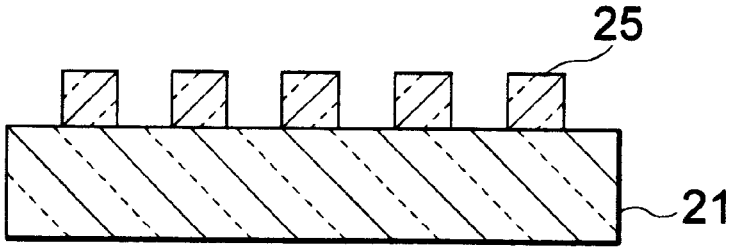

The method of making the diamond member in accordance with the present invention should not be restricted to the above-mentioned embodiment. For example, the process of forming the bulged portion on the substrate is not restricted to that mentioned above and can be in conformity to that shown in FIGS. 9A to 9D. First, a predetermined substrate 21 is prepared (FIG. 9A). Subsequently, after a mask 27 formed with a desired pattern is disposed on the substrate 21, a metal is deposited on the part of the substrate 21 other than the part where bulged portions 25 are to be made, thereby forming a mask layer 28 (FIG. 9B). Then, with the mask 27 removed, diamond is epitaxially grown on the substrate 21, thereby forming the bulged portions 25 (FIG. 9C). Here, due to the above-mentioned reason, the diameter of each opening formed in the mask 27 is slightly greater than 0.5 to 10 μm, and etching is effected till the bulged portion 25 attains a height of 1 to 100 μm or preferably 2 to 10 μm. Thereafter, the substrate 21 is washed with an acidic solution so as to eliminate the mask layer 28, thereby forming the bulged portions 25 alone on the substrate 21 (FIG. 9D). In this case, since no etching by RIE technique is performed, it is preferable that the surface of the substrate 21 be polished beforehand to enhance its smoothness.

In the following, the electronic device in accordance with the present invention will be explained.

Figure 10:
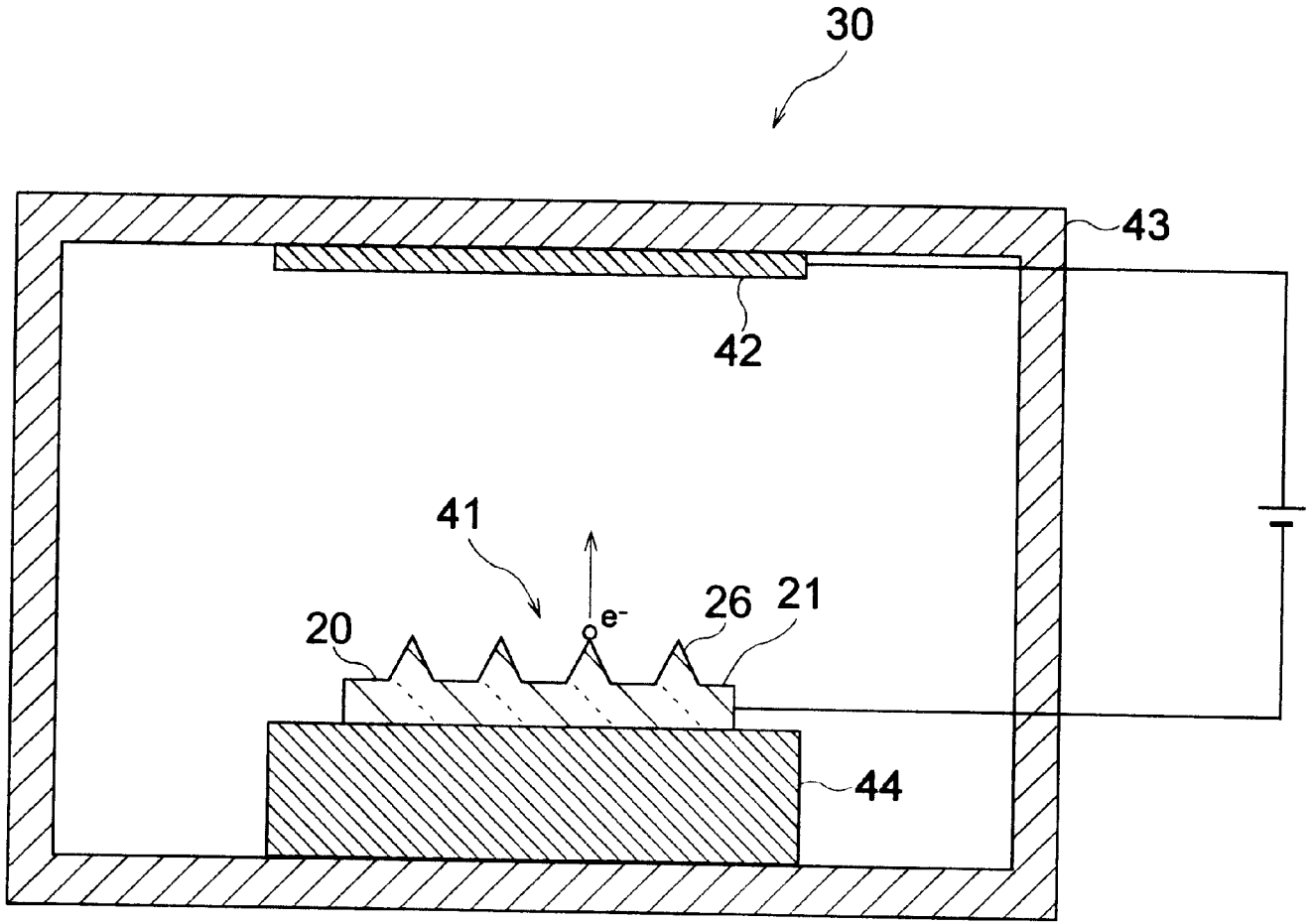
FIG. 10 is a sectional view schematically showing an embodiment of an electronic device.

FIG. 10 is a schematic sectional view of an electronic device 40 to which the present invention is applied. The depicted electronic device 40, which is adapted to function as a field-emission element, comprises a field-emission type electron-emitting element 41 made of a diamond member 10 configured in accordance with the present invention and a control electrode 42. The field-emission type electron-emitting element 41 is mounted on an insulating table 44 which is placed at the lower part within a vacuum envelope 43. In the upper part within the vacuum envelope 43, the control electrode 42 is disposed so as to oppose the field-emission type electron-emitting element 41 while being separated therefrom.

In this configuration, the control electrode 42 is set to a predetermined positive voltage with reference to the field-emission type electron-emitting element 41. Consequently, each protruded portion 12 of the diamond member 10 constituting the field-emission type electron-emitting element 41 functions as a minute electrode, whereby an electron ($e^-$) is drawn from the protruded portion 12. The field-emission current of each minute electrode exponentially changes relative to the field intensity according to Fowler-Nordheim expression.

Consequently, the protruded portion 12 having a small radius of curvature is quite advantageous to field emission. Also, since the substrate 11 and the protruded portion 12 are integrated with each other, no interface is formed therebetween, whereby there is no fear of the field-emission characteristic being undesirably influenced by contact resistance or the like.

Accordingly, when a voltage is applied between the field-emission type electron-emitting element 41 and the control electrode 42 even at a low level, electrons can be emitted in a greater number than those conventionally emitted, whereby a power-saving type electronic device can be realized.

Figure 11:
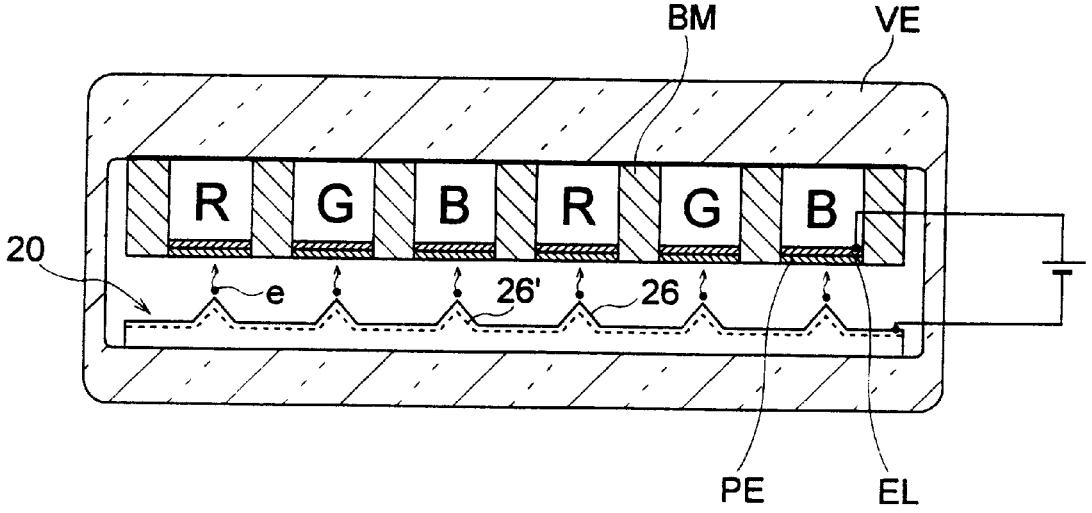
FIG. 11 is a sectional view showing a configuration of a display.

FIG. 11 shows a display equipped with the electron-emitting element 20. This display comprises a vacuum envelope VE within which the electron-emitting element 20 is disposed, and an electron-drawing electrode EL disposed within the vacuum envelope VE so that a voltage is applied between the electron-drawing electrode EL and the electron-emitting element 20. The electron-drawing electrode EL is placed at a position opposing each protrusion 26 of the electron-emitting element 20, while a phosphor PE adapted to emit light in response to the electron incident thereon is disposed on the electron-drawing electrode EL. Three primary color filters R, G, and B made of respective colored resins are formed on the discrete regions of phosphors PE, while being separated from each other by a black mask BM. A surface region 26' of each protrusion 26 is doped with impurities such as As, B, N, and P. When a voltage is applied between a specific diamond protrusion 26 of the electron-emitting element 20 and its corresponding electrode EL, an electron is emitted from the protrusion 26 so as to impinge on the phosphor PE. When the phosphor PE emits light in response to the electron incident thereon, thus emitted light passes through its corresponding one of color filters R, G, and B. By switching the electrodes EL to which electrons are emitted, light beams from the discrete color filters R, G, and B can be controlled independently from each other. These color filters R, G, and B constitute pixels.

Figure 12:
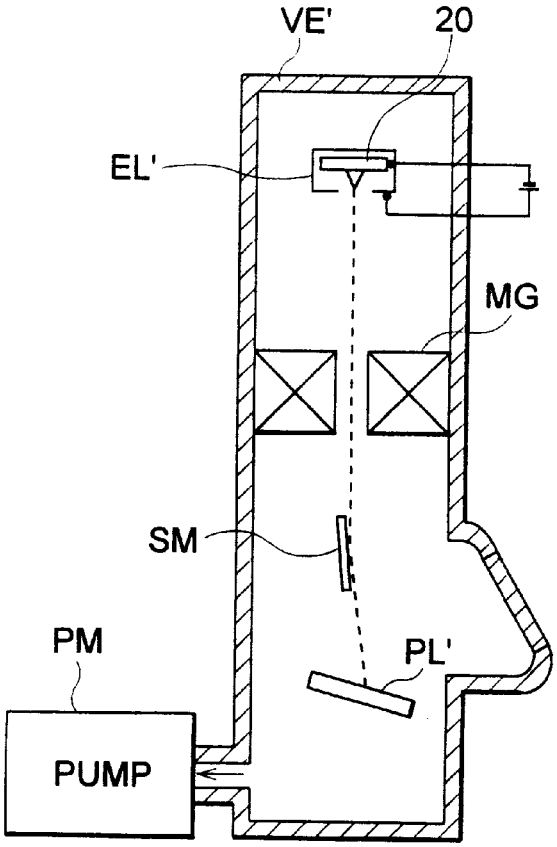
FIG. 12 is a sectional view of a reflection high energy electron diffraction (RHEED) apparatus.

FIG. 12 shows a reflection high energy electron diffraction (RHEED) apparatus. A voltage of several ten kV is applied between the electron-emitting element 20 and a drawing electrode EL', and the orbit of the emitted electron is adjusted by an electromagnet MG so as to impinge on a sample SM. The electron beam reflected by the surface of the sample SM impinges on a phosphor plate PL', whereby a diffraction image is displayed thereon. The electron-emitting element 20, electron-drawing electrode EL', sample SM, and phosphor plate PL' are disposed within a tube which is a vacuum envelope VE'. The vacuum envelope is evacuated by a pump PM.

EXAMPLE 1

The above-mentioned electron-emitting element was made. A substrate made of Ib type single-crystal diamond whose surface was a {100} face had been prepared beforehand by high-temperature high-pressure synthesis. A resist layer was formed on the substrate, and a photomask was placed thereon. Then, a predetermined pattern was formed on the resist layer by photolithography technique. Thereafter, a mask layer corresponding to the pattern of the resist layer was formed by etching technique. In this example, a plurality of mask layers each shaped like a disc having a diameter of about 8 $\mu$m were formed as being arranged in square lattices with a pitch width of 28 $\mu$m.

Figure 13:
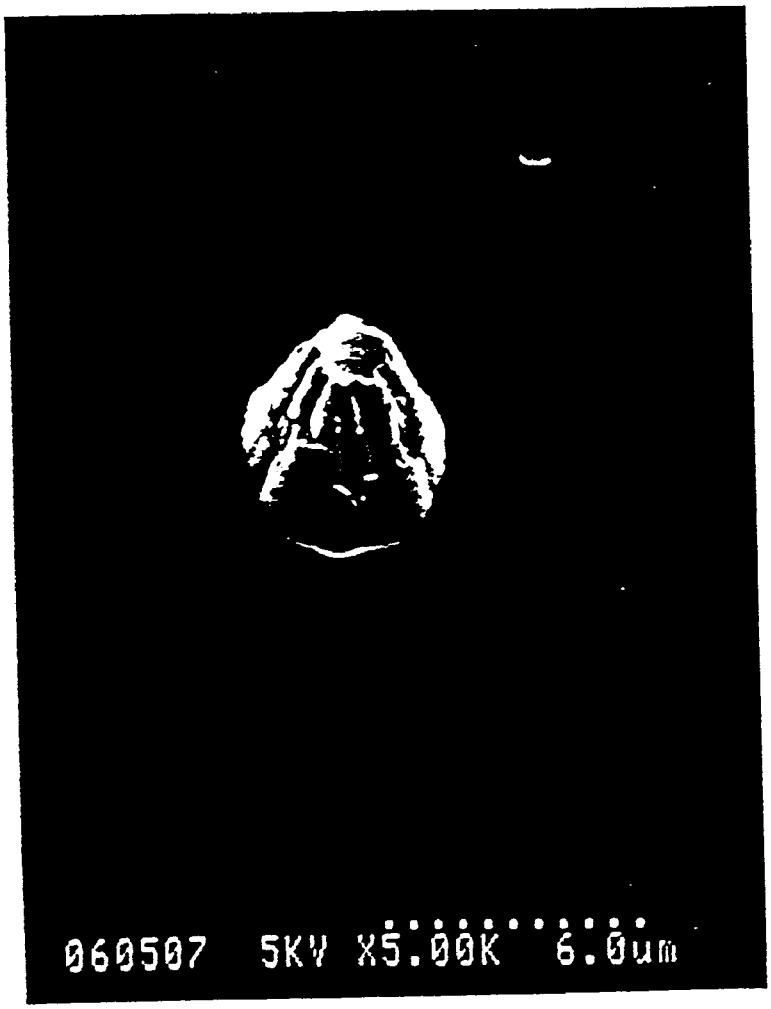
FIG. 13 is an electron micrograph of a seed projection.

Subsequently, this substrate was dry-etched by reactive ion etching technique. Here, a mixed gas composed of $CF_4$ with a molar fraction of 20% and $O_2$ with a molar fraction of 80% was used as the reactive gas, whereby cylindrical bulged portions each having a height of 3 to 4 $\mu$m and a diameter of 3 $\mu$m were integrally formed on the substrate. Thereafter, the mask layers were eliminated. FIG. 13 is an electron micrograph of one bulged portion.

Then, the substrate was mounted on the substrate holder of a microwave CVD apparatus, and its reaction chamber was evacuated to a predetermined pressure by a rotary pump. Subsequently, as a material gas, a mixed gas composed of methane gas and hydrogen with a molar ratio of [methane]/[hydrogen] at 6% to 7% was introduced from the supply port at 213 sccm, and the pressure within the reaction chamber was held at about 140 Torr. Then, the microwave power supply was turned on so as to introduce microwaves into the reaction chamber, thereby exciting the material gas and generating plasma. Here, the electric power applied to the microwave power supply was appropriately adjusted such that the substrate temperature becomes 940° to 960° C. When crystal growth was effected for about an hour in this state, a protruded portion having a crystal morphology surrounded by {111} faces was integrally formed on the substrate. As a result, the ratio of the growth rate in <100> direction to that in <111> direction under this experimental condition was found to be √3 or greater, thus yielding a desired diamond member.

EXAMPLE 2

Prepared as the substrate was Ib type single-crystal diamond whose surface is a {110} face. As with Example 1, the single-crystal diamond was made by high-temperature high-pressure synthesis. In a method similar to that of Example 1, cylindrical bulged portions were formed on the substrate, and then the microwave CVD apparatus identical to that of Example 1 was used for epitaxially growing diamond on the substrate. Here, as a material gas, a mixed gas composed of methane and hydrogen with a molar ratio of [methane]/[hydrogen] at 0.03 was introduced from the supply port at 206 sccm, and the pressure within the reaction chamber was held at about 140 Torr. Further, the substrate temperature was set to 1,040° to 1,060° C. When crystal growth was effected for about an hour in this state, a protruded portion having a crystal morphology surrounded by {111} and {100} faces was integrally formed on the substrate. As a result, the ratio of the growth rate in <100> direction to that in <111> direction under this experimental condition was found to be (√3)/2 (=0.87), thus yielding a desired diamond member.

EXAMPLE 3

Figure 14:
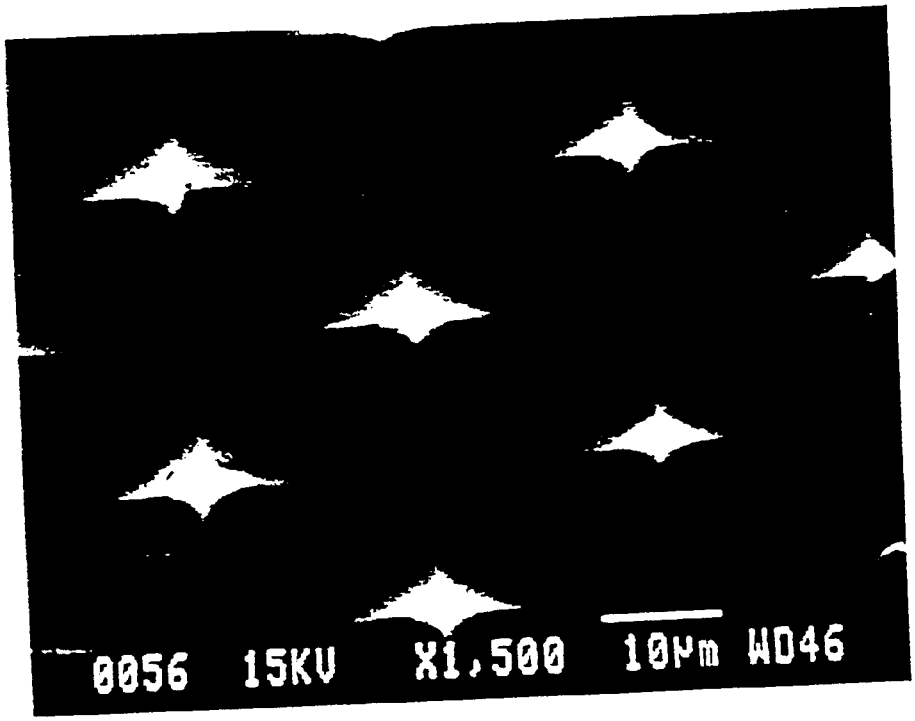
FIG. 14 is an electron micrograph of diamond protrusions.
Figure 15:
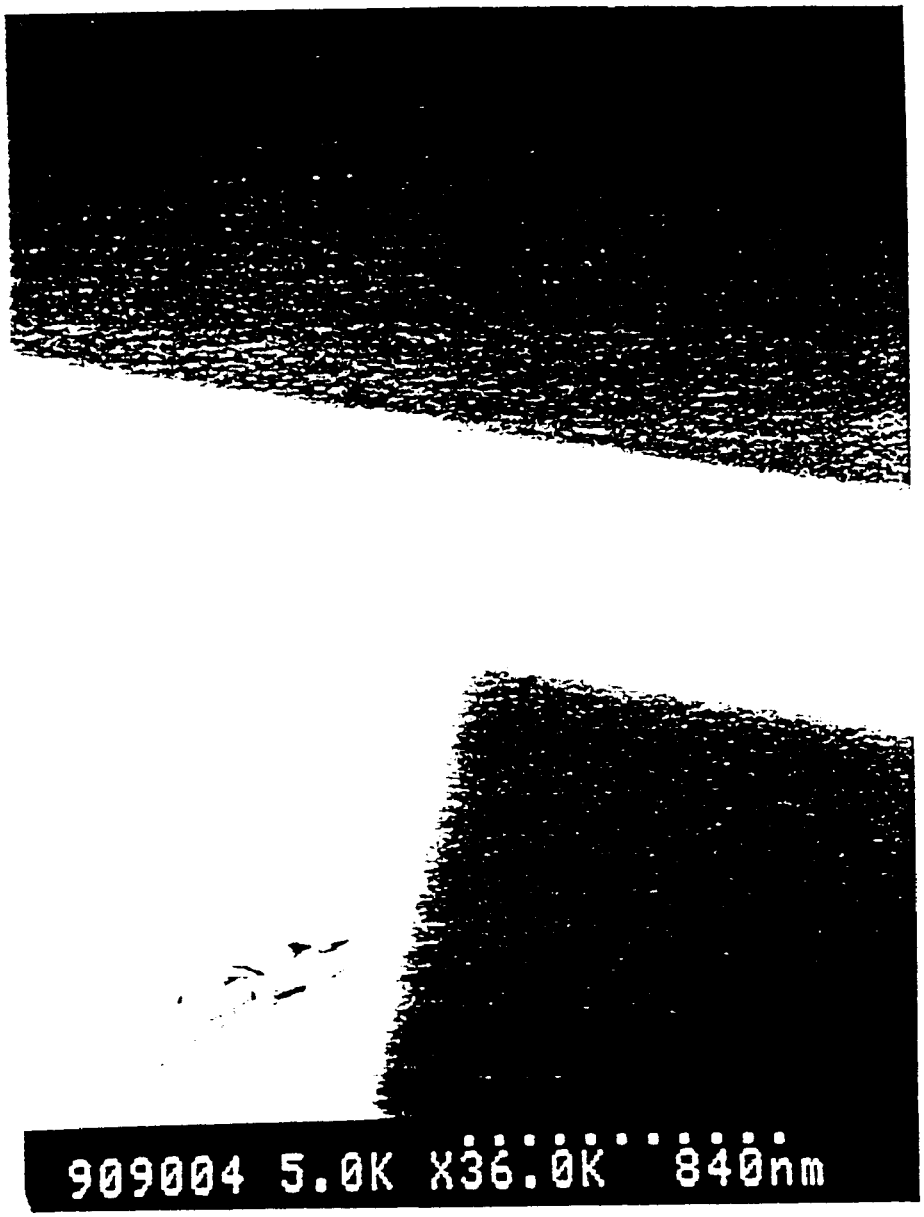
FIG. 15 is an electron micrograph of a tip portion of the diamond protrusion.

Conditions of Example 3 were the same as those of Example 1 except that, in the crystal growing process, as a material gas, a mixed gas composed of methane gas and hydrogen with a molar ratio of [methane]/[hydrogen] at 10% was introduced at 110 sccm, the pressure within the reaction chamber was about 140 Torr, the substrate temperature was 1,000° C., and the crystal growth time was an hour. FIG. 14 is an electron micrograph of thus formed diamond protrusions. This photograph shows a plurality of diamond protrusions. FIG. 15 is an electron micrograph of the tip portion of a diamond protrusion formed by such a method. The radius of curvature of the tip portion of the diamond protrusion formed by this method is on the order of several nm, thus being much smaller than that of the diamond protrusion formed by etching.

EXAMPLE 4

Figure 16:
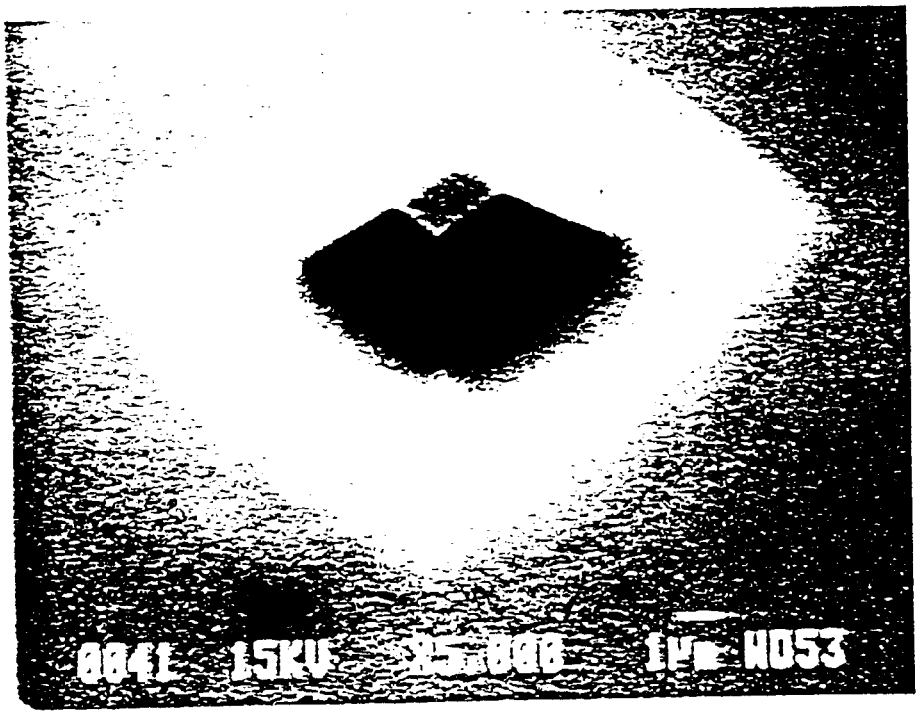
FIG. 16 is an electron micrograph of a diamond protrusion.

Conditions of Example 4 were the same as those of Example 3 except that the crystal growth time was 50 minutes in the crystal growing process. FIG. 16 is an electron micrograph of the tip portion of a diamond protrusion formed by such a method, in which the tip portion has been made flat.

EXAMPLE 5

Figure 17:
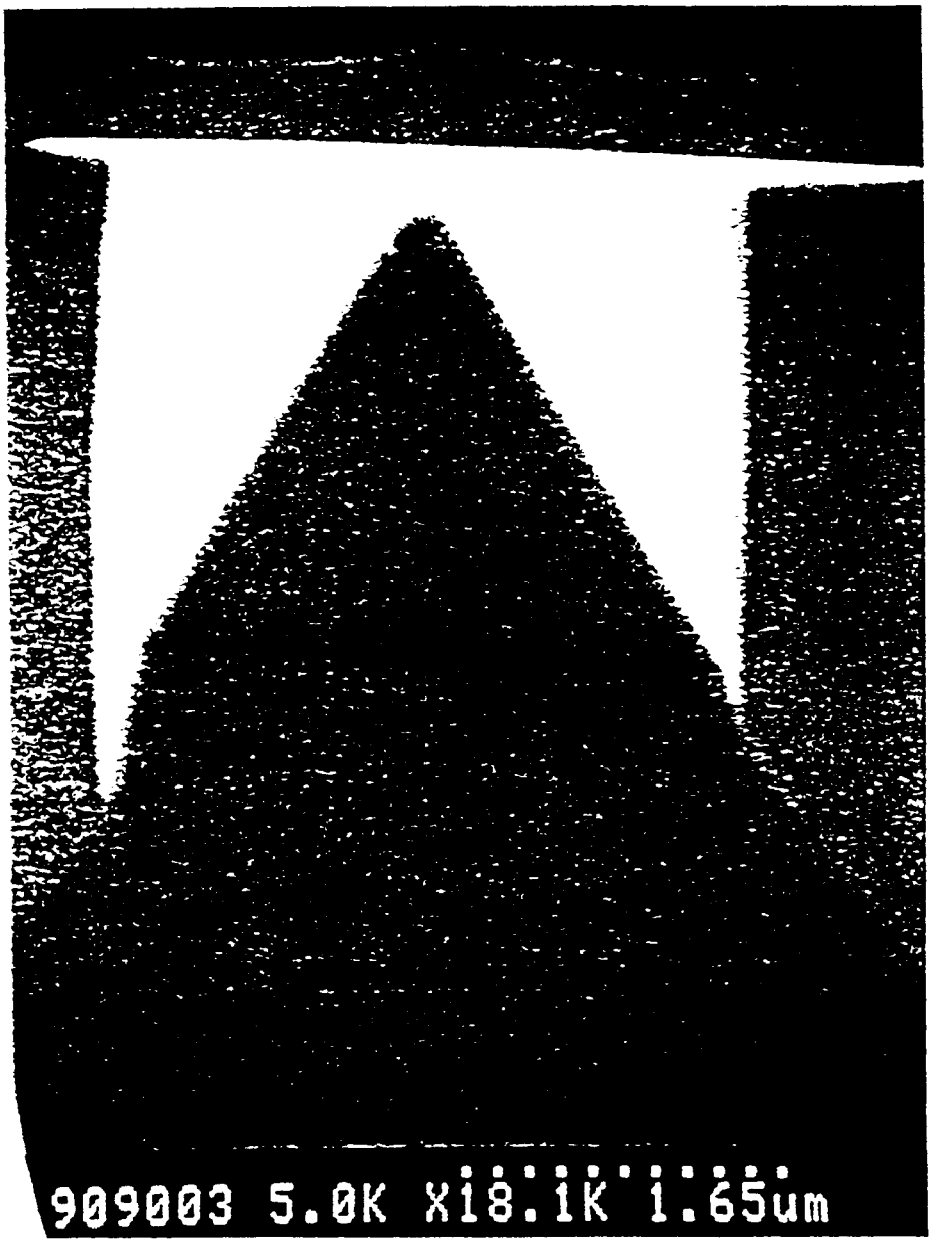
FIG. 17 is an electron micrograph of a diamond protrusion.

Conditions of Example 5 were the same as those of Example 3 except that the crystal growth time was 40 minutes in the crystal growing process. FIG. 17 is an electron micrograph of the tip portion of a diamond protrusion formed by such a method, in which ridge lines remain in the tip portion. Here, even at the same crystal growth time, depending on fluctuations in size among bulged portions, there may be a case where the diamond protrusion shaped as shown in FIG. 14 is obtained.

EXAMPLE 6

Figure 18:
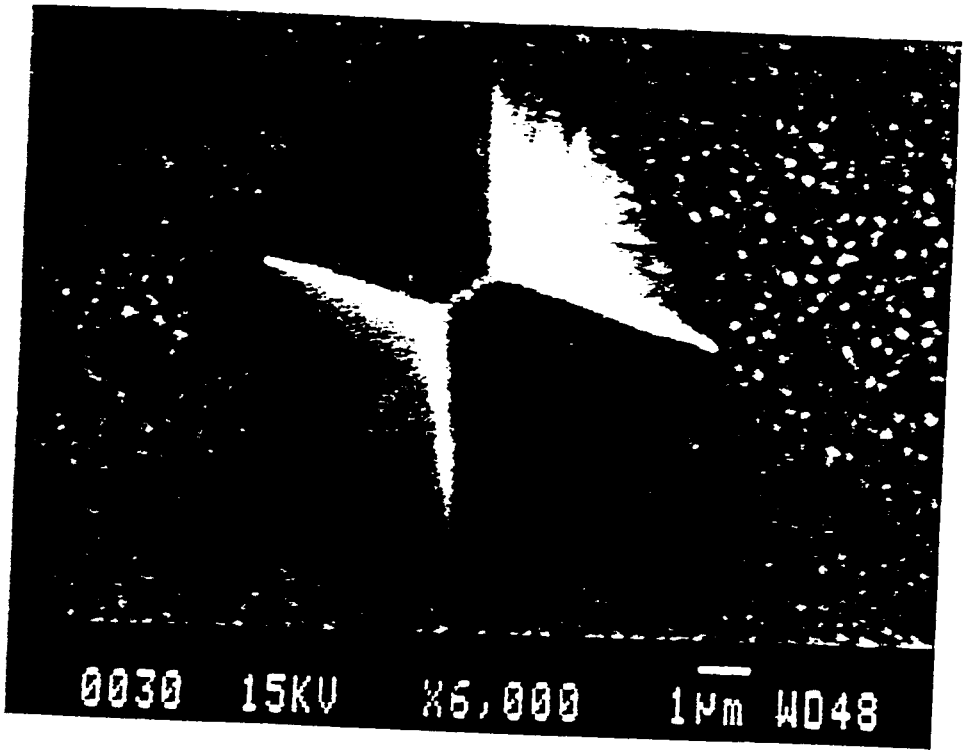
FIG. 18 is an electron micrograph of a diamond protrusion.

Conditions of Example 6 were the same as those of Example 2 except that a substrate made of Ib type single-crystal diamond whose surface was a {110} face was etched in the crystal growing process so as to form bulged portions and that, in its crystal growing process, as a material gas, a mixed gas composed of methane gas and hydrogen with a molar ratio of [methane]/[hydrogen] at 3% was introduced at 206 sccm, the pressure within the reaction chamber was about 140 Torr, the substrate temperature was 1,050° C., and the crystal growth time was an hour. FIG. 18 is an electron micrograph of the tip portion of a diamond protrusion formed by such a method, in which ridge lines remain in the tip portion.

Though the method of making a diamond member in accordance with the present invention is explained in the foregoing with reference to preferred embodiments and examples, the present invention should not be restricted thereto. The diamond member shown in FIG. 5B can also be obtained when the composition and flow rate of the material gas, pressure within the reaction chamber, temperature of the substrate, and the like are appropriately set.

In the above-mentioned diamond member, the protruded portion exhibiting automorphism on its surface is integrally formed on the substrate at a predetermined position. In this case, the protruded portion is pointed at an atomic level and has various characteristics inherent in a diamond single crystal. Also, the surface of the protruded portion is stable in terms of energy. Accordingly, a diamond member with a uniform quality can be obtained easily.

Also, in accordance with the above-mentioned method of making a diamond member, as the nucleus of crystal growth is intentionally disposed as the bulged portion on the substrate, the position at which the protruded portion is to be integrally formed on the surface of the substrate can be definitely determined. As a result, the diamond member can be made easily.

The electronic device in accordance with the present invention, which takes account of the fact that the protruded portion pointed at an atomic level is quite advantageous to field emission, is expected to be applicable to display devices such as FED, whereby electric power can be saved.

The electronic device is not only applicable to the FED. For example, it is also applicable to an electron gun for a scanning electron microscope (SEM) or electron diffraction, electron source for a field-emission microscope (FEM), rectifying device, current amplifying device, voltage amplifying device, high-frequency switch for power amplifying device, sensor, or the like.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is caimed is:

1. An electron-emitting element comprising:

a diamond substrate having a {100} surface; and a diamond protrusion grown on said surface of said diamond substrate, said diamond protrusion being surrounded by {111} faces, wherein said diamond protrusion includes a seed projection as a nucleus therein, said seed projection being previously formed on said diamond substrate.

2. An electron-emitting element comprising:

a diamond substrate having a {110} surface; and a diamond protrusion grown on said surface of said diamond substrate, said diamond protrusion being surrounded by {111} and {100} faces, wherein said diamond protrusion includes a seed projection as a nucleus therein, said seed projection being previously formed on said diamond substrate.

3. An electron-emitting element comprising:

a diamond substrate having a {111} surface; and a diamond protrusion grown on said surface of said diamond substrate, said diamond protrusion being surrounded by {100} faces, wherein said diamond protrusion includes a seed projection as a nucleus therein, said seed projection being previously formed on said diamond substrate.

4. An electron-emitting element comprising:

a diamond substrate having a surface; and a diamond protrusion grown on said surface of said diamond substrate, said diamond protrusion having a quadrangular pyramid portion exposing a tip part thereof, wherein said diamond protrusion includes a seed projection as a nucleus therein, said seed projection being previously formed on said diamond substrate.

5. An electron-emitting element according to claim 4, wherein said diamond protrusion has a truncated quadrangular pyramid portion whose upper and bottom surfaces are respectively continuous with the bottom surface of said quadrangular pyramid portion and said surface of said diamond substrate, an angle formed between a side ridge line of said truncated quadrangular pyramid portion and said surface of said diamond substrate being smaller than an angle formed between a side ridge line of said quadrangular pyramid portion and said surface of said diamond substrate, wherein said diamond protrusion includes a seed projection as a nucleus therein, said seed projection being previously formed on said diamond substrate.

6. An electron-emitting element according to claim 4, wherein said substrate is made of single-crystal diamond.

7. An electron-emitting element comprising:

a diamond substrate having a surface; and a diamond protrusion grown on said surface of said diamond substrate, said diamond protrusion having a truncated quadrangular pyramid portion exposing an upper surface thereof, wherein said diamond protrusion includes a seed projection as a nucleus therein, said seed projection being previously formed on said diamond substrate.

8. An electron-emitting element according to claim 7, wherein said substrate is made of single-crystal diamond.

9. An electron-emitting element comprising:

a diamond substrate having a surface; and a diamond protrusion grown on said surface of said diamond substrate, said diamond protrusion having a form surrounded by a first ridge line in parallel to said surface, second and third ridge lines extending so as to spread from one end of said first ridge line toward said surface, and fourth and fifth ridge lines extending so as to spread from the other end of said first ridge line toward said surface, wherein said diamond protrusion includes a seed projection as a nucleus therein, said seed projection being previously formed on said diamond substrate.

10. An electron-emitting element according to claim 9, wherein said substrate is made of single-crystal diamond.

* * * * *